166-105 SR
10/22/85 OR 4,548,263

United States Patent [19]
Woods

[11] Patent Number: 4,548,263
[45] Date of Patent: Oct. 22, 1985

[54] FITTING FOR DUAL SUBMERSIBLE PUMPS

[76] Inventor: Billy E. Woods, 11661 Alta Mesa Rd., Galt, Calif. 95632

[21] Appl. No.: 589,356

[22] Filed: Mar. 14, 1984

[51] Int. Cl.[4] ..... E21B 43/00
[52] U.S. Cl. ..... 166/105; 417/426
[58] Field of Search ..... 166/105, 107, 68, 369, 166/54.1; 417/426

[56] References Cited

U.S. PATENT DOCUMENTS

| | | | |
|---|---|---|---|
| 2,215,505 | 9/1940 | Hollander | 417/426 X |
| 2,668,500 | 2/1954 | Hoffer | 417/426 X |
| 3,602,611 | 8/1971 | Oplander | 417/426 X |
| 3,741,298 | 6/1973 | Canton | 166/105 |

*Primary Examiner*—Stephen I. Novosad
*Assistant Examiner*—Thuy M. Bui
*Attorney, Agent, or Firm*—Harvey B. Jacobson

[57] ABSTRACT

A fitting for use downhole in a well for connecting a pair of well pumps one above the other to the bottom of a drop pipe or the like, so that each of the pumps may discharge well fluid into the drop pipe, comprises an elongate housing with an inlet at its bottom end for connection to the discharge of one of the pumps, an outlet at its upper end for connection to the drop pipe, an elongate pocket portion between the ends for receipt of the second pump, the pocket portion defining a by-pass conduit for well fluid flowing from the first pump through the fitting to the outlet, and a further inlet for connecting the discharge of the second pump into the fitting at its upper end. The fitting is suitable for use in well casings down to a diameter of about six inches and the design of the fitting promotes smooth non-turbulent flow of well fluid therethrough.

6 Claims, 4 Drawing Figures

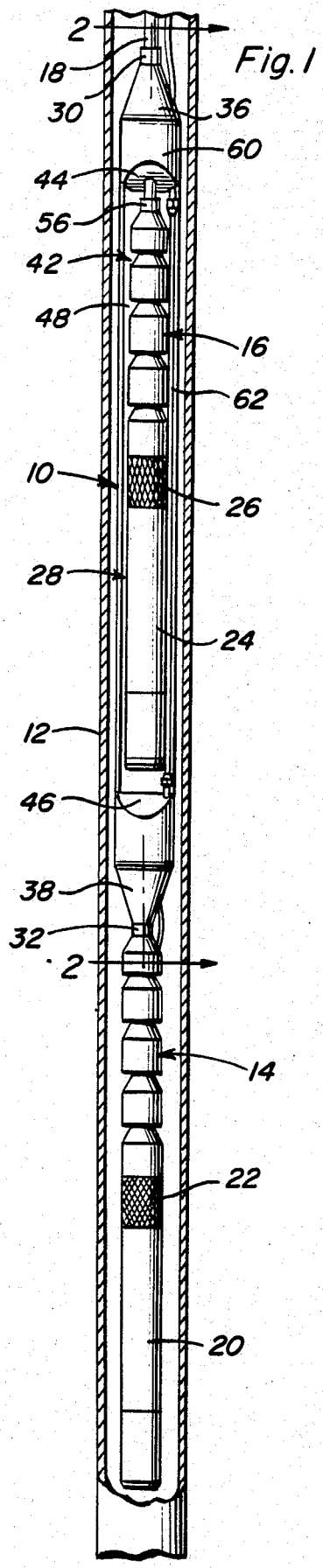
Fig. 1
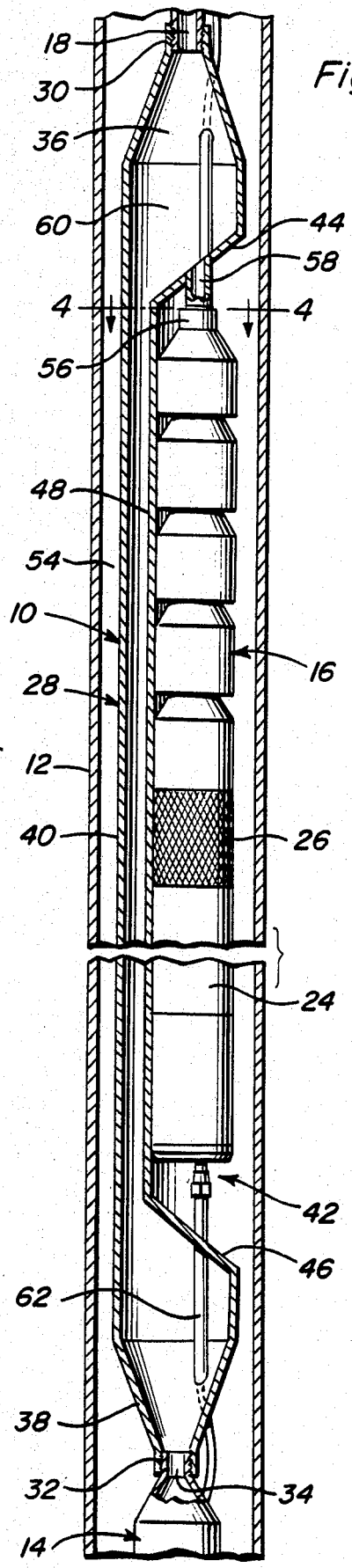
Fig. 2
Fig. 3
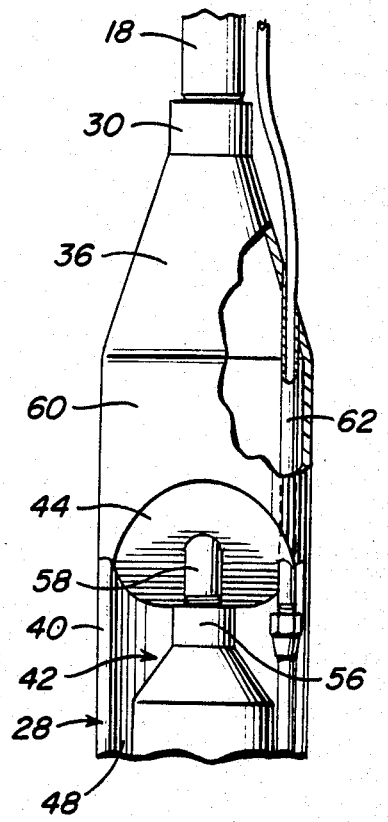
Fig. 4
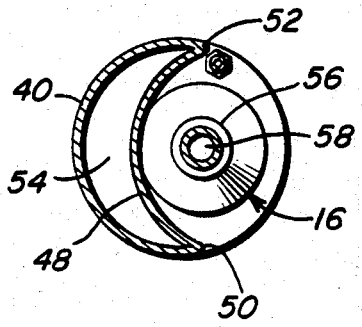

FITTING FOR DUAL SUBMERSIBLE PUMPS

BACKGROUND OF THE INVENTION

This invention relates to well pumping apparatus, more particularly to a downhole fitting which enables a pair of submersible pumps to be accommodated one above the other in a well casing for delivery of well fluid from each of the pumps into a well discharge pipe (drop pipe) or the like.

A well fitting in accordance with the invention may be used for increasing the pumping capacity of a well without having to increase the casing diameter, by using both pumps in tandem, or alternatively, the fitting may be used to obtain different pump capacities from a well, by providing the fitting with pumps of different respective capacity, and operating the pumps selectively.

STATEMENT OF PRIOR ART

The following U.S. patents relate to downhole well pump fittings and the like. None of these however discloses a pump fitting having the features of the present invention.

| | | |
|---|---|---|
| U.S. Pat. No. 2,215,505 | Hollander | 9-1940 |
| U.S. Pat. No. 2,668,500 | Hoffer | 2-1954 |
| U.S. Pat. No. 3,112,760 | Budd | 12-1963 |
| U.S. Pat. No. 3,602,611 | Oplander | 8-1971 |
| U.S. Pat. No. 3,741,298 | Canton | 6-1973 |

SUMMARY OF THE INVENTION

The invention provides a fitting for mounting a pair of submersible pumps one above the other downhole in a well casing at the bottom of a drop pipe or the like, so that each pump may be operated to pump well fluid through the drop pipe. The fitting may advantageously comprise an elongate, generally cylindrically shaped housing having an inlet at its lower end for connection to the discharge of a first of the pumps, and an outlet at its upper end for connection to the bottom end of the drop pipe or the like. The housing is shaped to form an elongate cutout or pocket portion for accommodating the second of the pumps, with the housing defining a conduit bypassing the pocket portion for delivery of fluid from the first pump to the fitting outlet, and with the discharge from the second pump communicating through a further inlet with the upper end of the housing through a housing wall section defining the upper end of the pocket portion, so that when used in tandem, the flows of fluid from the respective pumps merge in the upper end of the housing for delivery to the drop pipe.

The pocket portion of the housing may, in a preferred form of the invention, be defined by a concave longitudinal wall, the edges of which merge with the outer wall of the housing, thereby defining a crescent-shaped conduit portion for fluid flowing from the first pump, and inclined part-elliptically shaped end walls, the inclination of which is preferably about 45°. This construction combined with the provision of tapered bell-like ends of the housing is effective in producting non-turbulent flow of fluids through the fitting.

Fittings in accordance with the invention may be made in sizes to suit different diameter well casings down to casings of about six inches diameter. The fittings may be used with pumps of the same or different diameter, and with motor-driven impeller-type pumps, or with line-drive turbine-type pumps.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE DRAWINGS

FIG. 1 is an elevational view of a fitting in accordance with the invention in position downhole in a well casing.

FIG. 2 is an enlarged sectional view on line 2—2 of FIG. 1.

FIG. 3 is a further enlarged view of a part of the fitting as shown in FIG. 1.

FIG. 4 is a sectional view on line 4—4 of FIG. 2.

DESCRIPTION OF PREFERRED EMBODIMENT

A fitting 10 in accordance with the invention may be used downhole in a well casing 12 to enable the well to be operated by a pair of pumps 14 and 16 (either individually or in tandem) located one above the other, and which each discharge well fluid into a common drop pipe 18, at the bottom of which the fitting 10 is connected in a manner to be described.

Each of pumps 14 and 16 may be a conventional submersible multi-stage, motor-driven, impeller-type pump of a type well known in the well pumping art. Pump 14 has a drive motor 20 and an inlet strainer 22 while pump 16 has a drive motor 24 and an inlet strainer 26.

Fitting 10 comprises an elongate, generally cylindrical housing 28 having a tubular outlet portion 30 at its upper end threaded to the bottom of the drop pipe, and a tubular inlet portion 32 at its lower end threaded to discharge fitting 34 of pump 14. Tubular portions 30 and 32 may be connected to the central portion of housing 28 by tapered, bell-like or frusto-conical portions 36 and 38. The central portion of the housing comprises a tubular member 40 which is cut away from an elongate cutout or pocket portion 42 defined by upper and lower end walls 44,46 and a longitudinal wall 48, each suitable connected to tubular member 40 by welding or the like. Longitudinal wall 48 may be of concave cross section with its longitudinal edges merging with the edges of member 40 as indicated at 50 and 52 in FIG. 4. Thus, the housing defines a crescent-shaped bypass conduit 54 around pump 16 for fluid flowing through the housing from pump 14 to outlet 30. The upper and lower pocket-defining walls 44,46 of the housing are each of part-elliptical shape angled at about 45° to the longitudinal axis of the fitting.

Discharge fitting 56 of pump 16 is threaded to a conduit 58 forming an inlet through with upper wall 44 of the housing. Thus, in use, with both pumps immersed in well fluid, if the pumps are operated in tandem, the flows from the respective pumps merge in upper section 60 of housing 28. The construction of the fitting including the provision of the bell-like end portions 36 and 38 and the inclined walls 44,46 promotes smooth non-turbulent flow of fluid therethrough and into drop pipe 18. The fitting is provided with conduit 62 for electrical cable for energizing the respective pump motors.

The construction of fitting 10 allows it to be used in various size well casings down to about six inch diameter casings. For a six inch diameter casing, for example, the outer diameter of housing 28 may be about five and one-half inches and the pumps may be four inch diameter units. For a ten inch diameter casing, the outer diameter of the housing may be about eight inches and the pumps may be six inch diameter units. However, while the invention has been illustrated using a pair of pumps of similar diameter, it is possible for the lower pump (pump 14 in the drawings) to have a larger diameter, up to or larger than the diameter of housing 28 if required, within the confines of the well casing in which the fitting is to be used. Also, while the invention has been illustrated with respect to motor-drive impeller-type pumps, the invention can also be adapted for use with line-driven turbine-type pumps. This may require the housing 28 to be somewhat redesigned in an offset manner with non-symmetrical bell-like sections at each end to accommodate such pumps and drive shafts. Further, while the invention has been described predominantly as using a pair of pumps to be operated in tandem to increase the pumping capacity in a well, the invention also contemplates the use of the pumps individually, for example if different pump capacities are required from a well such as from an irrigation size pump and a domestic water size pump or, where, for example, an auxiliary back-up facility of one pump for the other is required.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A fitting for use downhole in a well casing on the bottom end of a drop pipe or the like for accommodating a pair of submersible pumps in the casing one above the other for discharge of each pump into the drop pipe, the fitting comprising an elongate housing having an upper end formed with an outlet for connection to the drop pipe or the like, a lower end formed with an inlet for connection to the discharge of a first of the pumps, the housing defining an elongate pocket portion between the upper and lower ends for accommodating the second of the pumps and a conduit bypassing the pocket portion for delivery of fluid from the inlet to the outlet, the housing having a further inlet for connection to the discharge of the second pump, the further inlet being located at the upper end of the pocket portion, wherein the housing comprises a central section between the respective ends including a part-cylindrical outer wall, the pocket portion being defined by a concave longitudinal wall having edges merging with the respective edges of the outer wall whereby said conduit is provided with a portion of crescent shaped cross section, and inclined upper and lower end walls of part-elliptical shape connected between the longitudinal wall and the outer wall, the upper end plate being inclined upwardly from a connection with the longitudinal wall to a connection with the outer wall and the lower end plate being inclined downwardly from a connection with the longitudinal wall to a connection with the outer wall, the further inlet being formed in the upper end wall and the central section of the fitting being connected to the respective ends of the fitting by symmetrical bell-like frusto-conical portions.

2. The invention of claim 1 wherein the end walls are inclined at about 45° with respect to the longitudinal axis of the fitting.

3. The invention of claim 1 wherein the outer wall has a diameter of no more than about five and one-half inches for use of the fitting in a six inch diameter well casing.

4. The invention of claim 1 in combination with a pair of pumps connected to the respective inlets.

5. The invention of claim 4 wherein the pumps are each of the same diameter.

6. The invention of claim 4 wherein the pumps are motor-driven, impeller-type pumps.

* * * * *